US007770742B1

(12) United States Patent
Wagner et al.

(10) Patent No.: US 7,770,742 B1
(45) Date of Patent: Aug. 10, 2010

(54) SHOWER CADDY

(76) Inventors: George Wagner, 4137 Narada Falls, N. Las Vegas, NV (US) 89085; Vicki Cooper, 4137 Narada Falls, N. Las Vegas, NV (US) 89085

( * ) Notice: Subject to any disclaimer, the term of this patent is extended or adjusted under 35 U.S.C. 154(b) by 246 days.

(21) Appl. No.: 11/874,868

(22) Filed: Oct. 18, 2007

(51) Int. Cl.
*A47G 29/87* (2006.01)
*A47F 5/08* (2006.01)

(52) U.S. Cl. ..... 211/119.009; 211/113

(58) Field of Classification Search ..... 211/86.01, 211/90.04, 106, 113, 117, 118, 119, 119.009, 211/181.1; 248/206.3, 212, 302, 317; 4/559, 4/596, 605; D6/525; 285/139.2, 141.1, 192–195; 206/806
See application file for complete search history.

(56) References Cited

U.S. PATENT DOCUMENTS 574,339 A * 12/1896 Moore ..... 4/240
623,377 A * 4/1899 Leger ..... 211/113
1,080,520 A * 12/1913 Schuermann ..... 285/46
1,137,333 A * 4/1915 Klorer ..... 403/57
1,502,154 A * 7/1924 Mueller et al. ..... 137/359
2,199,851 A * 5/1940 Culver ..... 248/264
2,214,118 A * 9/1940 Bracken ..... 211/94.01
2,381,189 A * 8/1945 Thomas ..... 248/212
2,410,999 A * 11/1946 Reisner ..... 174/8
2,532,427 A * 12/1950 Smith ..... 285/195
2,760,648 A * 8/1956 Van Dusen ..... 211/118
2,941,671 A * 6/1960 Lewis et al. ..... 211/119.009
D193,500 S * 9/1962 McGeehan ..... D6/525
3,059,374 A * 10/1962 Bernay ..... 211/113
D195,452 S * 6/1963 McGeehan ..... D6/525
3,125,358 A * 3/1964 Kleinberg ..... 285/55
3,181,702 A * 5/1965 Raphael ..... 211/119
3,231,200 A * 1/1966 Heald ..... 239/318
3,266,764 A * 8/1966 Briles ..... 248/213
3,307,710 A * 3/1967 Negri ..... 211/119.009
3,308,471 A * 3/1967 Weston ..... 343/882
3,333,808 A * 8/1967 Du Boff ..... 248/200.1
3,419,288 A * 12/1968 Logsdon ..... 285/58
3,461,870 A * 8/1969 Van Linge ..... 604/118
3,789,996 A 2/1974 Stroh
3,923,162 A 12/1975 Hussey
4,072,397 A * 2/1978 Ross ..... 359/512
4,108,314 A * 8/1978 Racca ..... 211/74
4,387,811 A 6/1983 Ragir et al.
4,457,031 A * 7/1984 Moore ..... 4/614
4,516,749 A * 5/1985 Sullivan ..... 248/56
4,541,131 A * 9/1985 Sussman ..... 4/596
4,573,591 A * 3/1986 Chap ..... 211/113
4,598,891 A * 7/1986 Hanert ..... 248/340
D285,509 S * 9/1986 Sussman ..... D6/525
D286,599 S * 11/1986 Sussman ..... D6/525
D293,183 S * 12/1987 Aaron ..... D6/525
D309,225 S * 7/1990 Scarbro ..... D6/525
4,998,647 A * 3/1991 Sharp ..... 222/143
D315,840 S * 4/1991 Emery ..... D6/525
5,070,553 A * 12/1991 Chambers ..... 4/615

(Continued)

*Primary Examiner*—Darnell M Jayne
*Assistant Examiner*—Joshua Rodden

(57) ABSTRACT

A shower caddy that securely supports itself along the water supply line of the shower head. The shower caddy support mounting assembly includes a rubber gasket, a shower head support, and a set screw. The shower caddy requires the temporary removal of the shower head in order to install the shower caddy. The shower caddy frame is made from a durable plastic or lightweight material that resists oxidation.

3 Claims, 5 Drawing Sheets

U.S. PATENT DOCUMENTS 5,180,067 A * 1/1993 Conaway et al. ..... 211/119
5,192,427 A * 3/1993 Eger et al. ..... 210/133
5,255,401 A 10/1993 Sambrookes et al.
D348,369 S 7/1994 Nakamura
5,564,566 A 10/1996 Lamb
5,604,633 A * 2/1997 Christianson ..... 359/507
D382,750 S * 8/1997 Andrus ..... D6/525
D390,642 S * 2/1998 Valentin ..... D23/304
5,950,381 A * 9/1999 Stansbie ..... 52/220.8
D417,990 S * 12/1999 Yemini ..... D6/525
6,149,277 A * 11/2000 Broussard ..... 359/512
6,378,912 B1 * 4/2002 Condon et al. ..... 285/220
6,520,351 B1 2/2003 Zadro
D477,947 S * 8/2003 Snell ..... D6/525
D479,073 S * 9/2003 Snell ..... D6/525
6,726,161 B2 * 4/2004 Plump et al. ..... 248/205.1
D489,207 S * 5/2004 Rosen ..... D6/525
D493,991 S * 8/2004 Dretzka ..... D6/525
D494,793 S * 8/2004 Winkleman ..... D6/525
D496,549 S * 9/2004 Snell ..... D6/525
D498,102 S * 11/2004 Snell ..... D6/525
6,973,682 B2 * 12/2005 Zhadanov ..... 4/601
D513,373 S * 1/2006 Harwanko ..... D6/525
D564,257 S * 3/2008 Yang et al. ..... D6/462
D564,271 S * 3/2008 Snider ..... D6/525
D564,816 S * 3/2008 Snider ..... D6/525
D566,441 S * 4/2008 Dretzka ..... D6/525
D568,657 S * 5/2008 Snider ..... D6/525
D568,658 S * 5/2008 Yang et al. ..... D6/525
D572,062 S * 7/2008 Snider ..... D6/525
2004/0188577 A1 * 9/2004 Gaderick ..... 248/230.1
2006/0138292 A1 * 6/2006 Yang ..... 248/206.3
2006/0261022 A1 * 11/2006 Sampaio ..... 211/119.009
2007/0045208 A1 * 3/2007 Quan ..... 211/119
2008/0035592 A1 * 2/2008 Yang et al. ..... 211/119.009
2008/0047913 A1 * 2/2008 Naden et al. ..... 211/119.009
2008/0224011 A1 * 9/2008 Chang ..... 248/317
2009/0078591 A1 * 3/2009 Hofman ..... 206/77.1
2009/0165269 A1 * 7/2009 Naden et al. ..... 24/716

* cited by examiner

FIG. 2
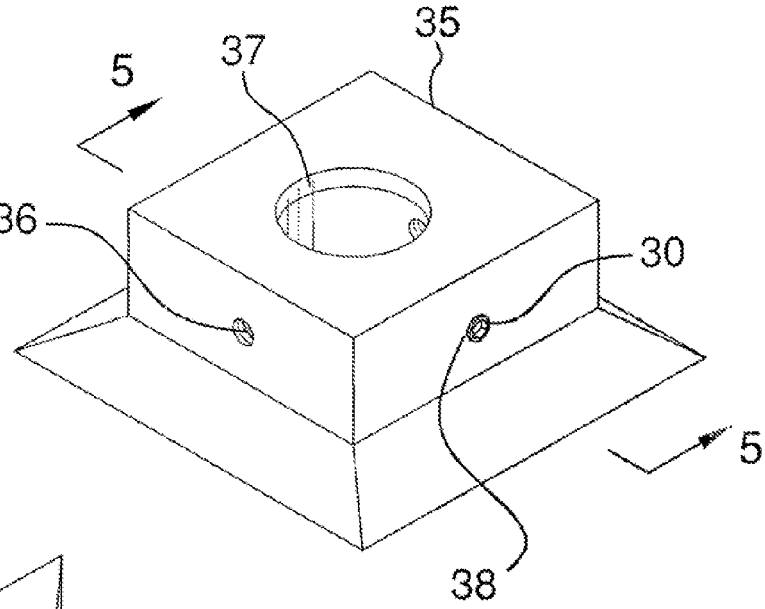
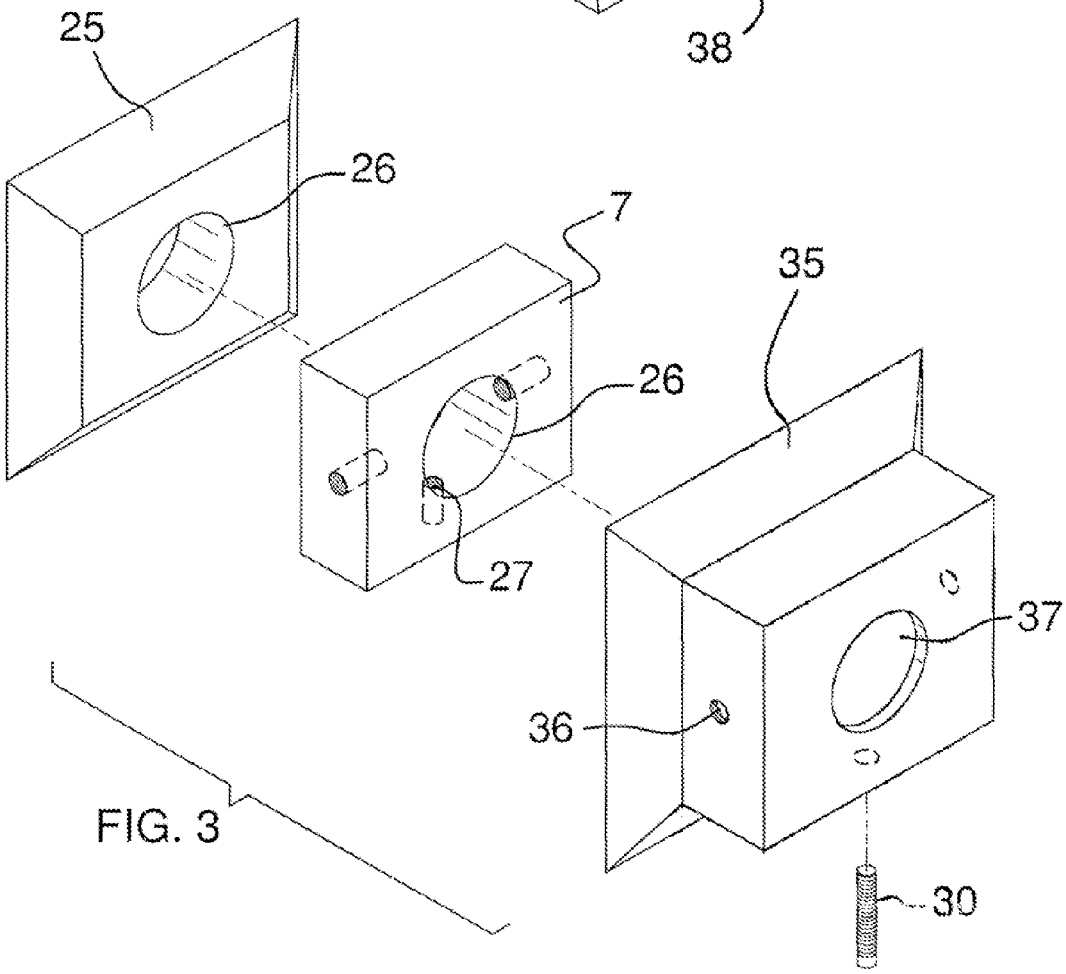
FIG. 3

FIG. 6
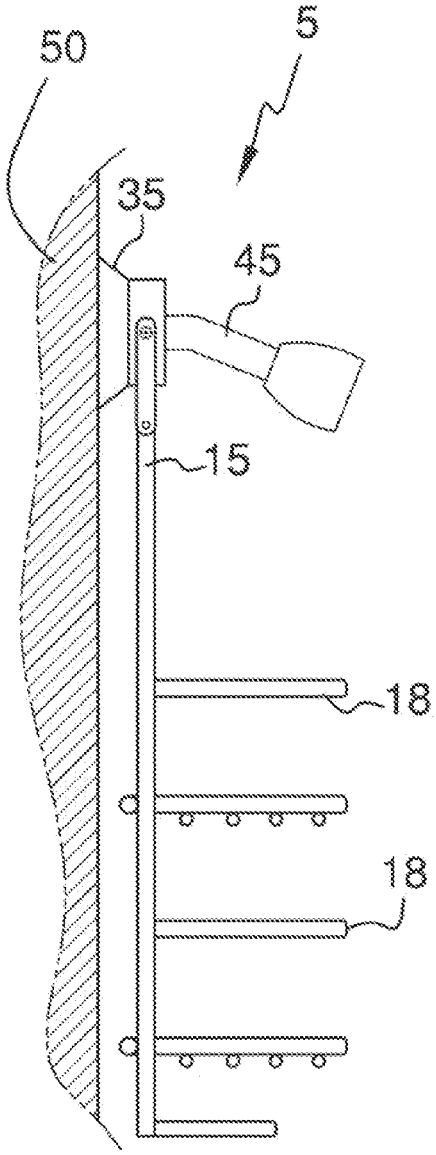
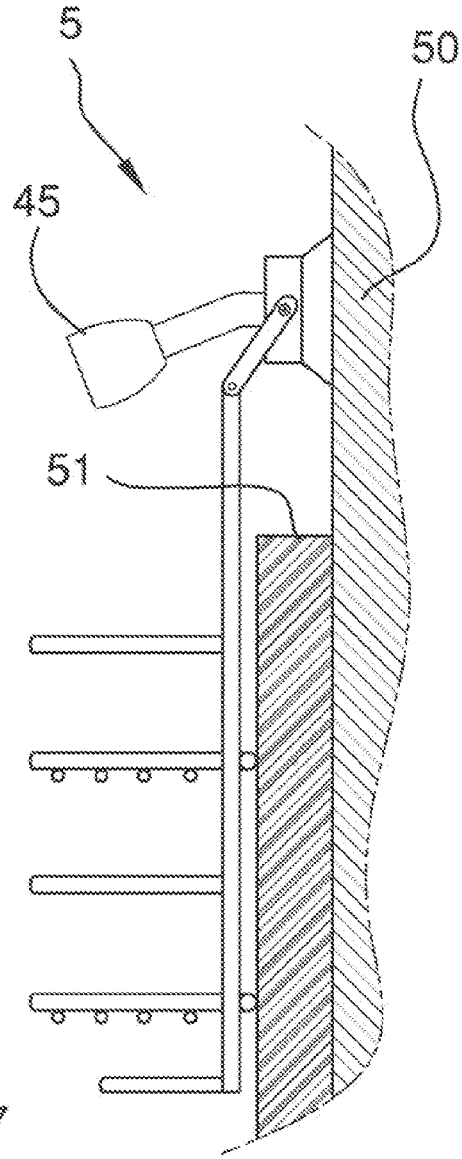
FIG. 7

SHOWER CADDY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of shower caddy systems, more specifically, a shower caddy that will not slide off of a water supply pipe while in use.

There are a multitude of shower caddies available on the market today. However, the shower caddies of today tend to slide down the water supply pipe of the shower head, and ultimately falling and or dropping the contents being supported by the shower caddy. This invention seeks to eliminate this dilemma by creating a shower caddy that secures itself to the water supply pipe.

B. Discussion of the Prior Art

As a preliminary note, it should be stated that there is an ample amount of prior art that deals with shower caddies. As will be discussed immediately below, no prior art discloses a caddy that has a rubber gasket for securement with a shower pipe and a pivoting hinge assembly to adjust the location of the caddy to varying wall locales.

The Lamb patent (U.S. Pat. No. 5,564,566) discloses an outdoor faucet organizing basket. However, the outdoor faucet organizing basket disclosed under the Lamb patent does not use a rubber gasket in conjunction with a shower head support in order to securely support the shower caddy to the water pipe of the shower head.

The Hussey patent (U.S. Pat. No. 3,923,162) discloses a shower caddy which attaches to a shower head using a screw-type bolt. However, the shower caddy disclosed under the Hussey patent does not secure the shower caddy to the water pipe of the shower head by using a rubber gasket in conjunction with a shower head support that is held in place by a set screw.

The Stroh patent (U.S. Pat. No. 3,789,996) discloses a shelf fixture which attaches to the water supply pipe of a shower stall. Even though the shelf fixture of the Stroh patent attaches to the water supply pipe, it does not utilize a rubber gasket in conjunction with a shower head support and a set screw, but rather uses a curved section of the metal frame to rest over the water supply pipe.

The Sambrookes et al. patent (U.S. Pat. No. 5,255,401) discloses a shower caddy which attaches to a shower arm or pipe. However, the attaching means of the shower caddy of the Sambrookes patent does not use a rubber gasket in conjunction with a shower head support, but rather a pair of grips that tighten over the water supply pipe via a pair of bolts and nuts.

The Zadro patent (U.S. Pat. No. 6,520,351) discloses a shower caddy for holding personal care articles which is attached to a shower head. However, the shower caddy of the Zadro patent uses parts of the frame of the shower caddy to rest the shower caddy over the shower head, as opposed to the friction from a rubber gasket and the force of a set screw as the means to secure the shower caddy to the water supply pipe of the shower head.

The Ragir et al. patent (U.S. Pat. No. 4,387,811) discloses a wire shelf structure which is adapted to be supported from a shower arm, but does not secure itself to the shower head via a rubber gasket and set screw combination.

The Nakamura patent (U.S. Pat. No. Des. 348,369) illustrates a design for a storage rack for use in a bathroom, which does not illustrate a fastening means including a rubber gasket with a shower head support and set screw assembly.

BRIEF SUMMARY OF THE INVENTION

The shower caddy securely supports itself along the water supply line of the shower head. The shower caddy support mounting assembly comprises a rubber gasket, shower head support, and set screw. The invention requires the temporary removal of the shower head in order to install the invention. The shower caddy frame is made from a durable plastic or lightweight metal that resists oxidation.

These together with additional objects, features and advantages of the shower caddy will be readily apparent to those of ordinary skill in the art upon reading the following detailed description of presently preferred, but nonetheless illustrative, embodiments of the shower caddy when taken in conjunction with the accompanying drawings.

In this respect, before explaining the current embodiments of the shower caddy in detail, it is to be understood that the shower caddy is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shower caddy.

it is therefore important that the claims be regarded as including such equivalent construction insofar as they do not depart from the spirit and scope of the shower caddy. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 2 illustrates an isometric view of the shower caddy support mounting assembly;

FIG. 3 illustrates an exploded view of the shower caddy support mounting assembly;

FIG. 6 illustrates a right side view of the invention in use with the hinge downward; and FIG. 7 illustrates a left side view of the invention in use with the hinge pivoting outwards.

DETAILED DESCRIPTION OF THE EMBODIMENT

Figure 1:
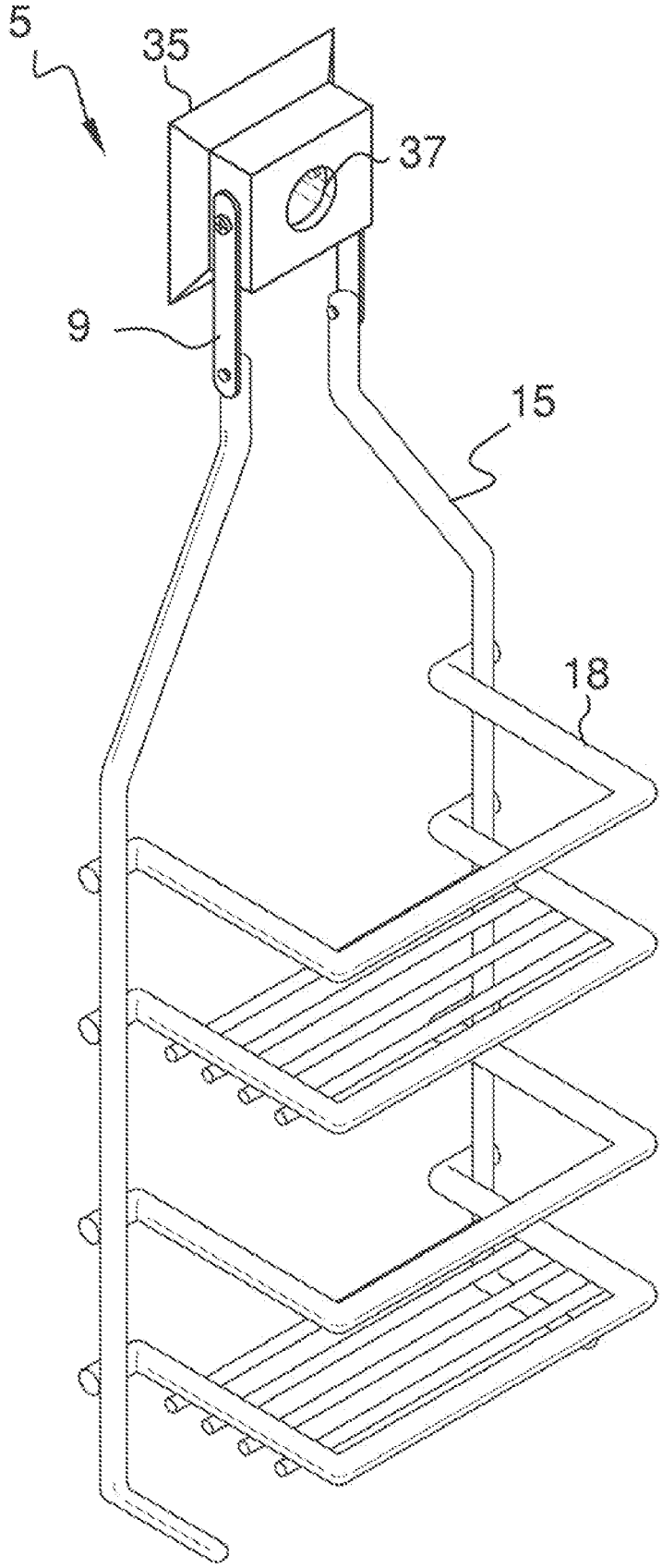
FIG. 1 illustrates an isometric view of the invention.

Detailed reference will now be made to the preferred embodiment of the present invention, examples of which are illustrated in FIG. 1-7. A shower caddy 5 (hereinafter invention) includes a shower caddy structure 15, a rubber gasket 25, a base 7, and a shower head support 35.

The invention 5 requires the shower caddy structure 15 to connect to the shower head support 35 by a pair of screws 16 where each travel through the holes 17 located on the pivoting hinge assembly 9 and are screwed inside the internal threaded holes 36 in the shower head support 35. The shower caddy structure 15 is attached to the pivoting hinge assembly 9 through the use of two rivets 8. The shower caddy structure 15 has a plurality of shelves 18 to store articles that are required when in a shower.

The shower head support 35 has a water supply hole 37 for enabling a water supply pipe 45 to pass through the shower head support 35 in order for the invention 5 to be installed. The gasket 25 and the base 7 have a water supply hole 26 that is aligned with the water supply hole 37 of the shower head support, and fulfills the same purpose as the water supply hole 37.

The base 7 has a set screw hole 27 that contains internal threading, and the shower head support 35 has a corresponding set screw hole 38, which does not require internal threading. The set screw holes 27 and 38 enable the base 7 and shower head support 35 to be secured to the water supply pipe 45 by a set screw 30. It shall be noted that the internal threading is only required for the set screw hole 27 of the base 7 where the set screw 30 will apply a force against the water supply pipe 45.

The invention 5 is installed by removing a shower head 46 from the water supply pipe 45. Next the gasket 25 is placed over the water supply pipe 45, and positioned next to the wall. Next the base 7 is placed over the water supply pipe 45 and positioned next to the gasket 25. Next, the shower head support 35 is placed over the base 7 making sure the set screw holes 27 and 38 are aligned, and abutting the shower head support 35, wherein both the gasket 25 and the outermost edge of the shower head support 35 are touching the wall. Next the set screw 30 is screwed into the set screw holes 27 and 38 until the set screw 30 is tightened up against the water supply pipe 45.

Figure 4:
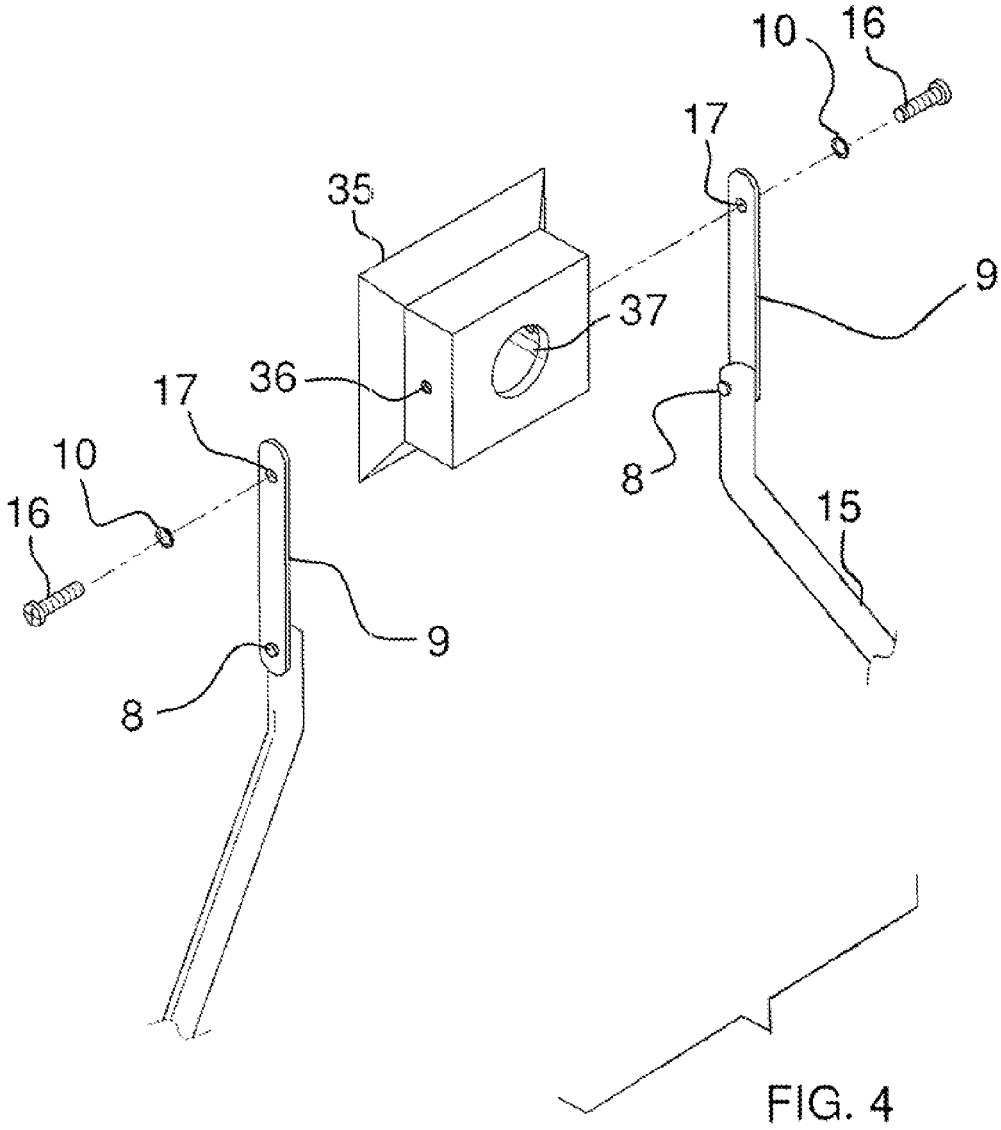
FIG. 4 illustrates how the shower caddy attaches to the shower caddy support mounting assembly.
Figure 5:
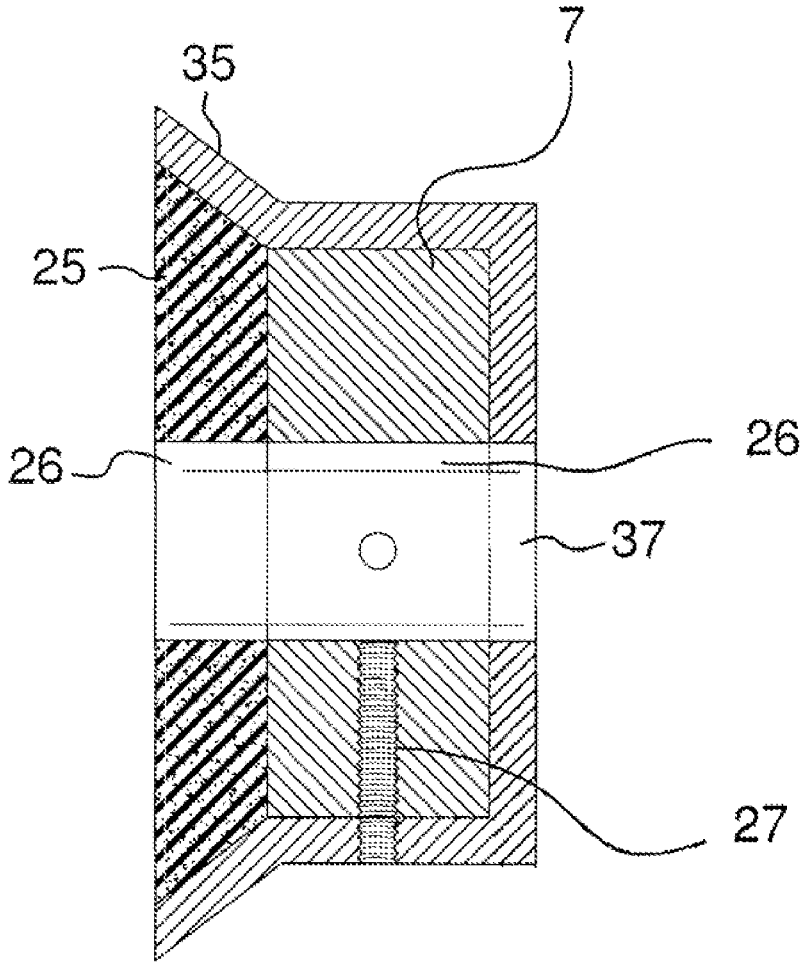
FIG. 5 illustrates a cross-sectional view of the shower caddy support mounting assembly along line 5-5.

Next the pivoting hinge assembly 9 attaches the shower caddy structure 15 to the shower head support 35 by the screws 16 along holes 17 of the pivoting hinge assembly 9, as depicted in FIG. 4. It shall be noted from FIG. 4, than an "O" ring 10 is used to interact with the head of the screw 16 and the corresponding surface of the hole 17 of the pivoting hinge assembly 9. Finally, the shower head 46 is reinstalled over the water supply pipe 45.

As depicted in FIG. 6 and FIG. 7, the pivoting hinge assembly 9 may hang straight downwards parallel with the surface of a wall 50, or the pivoting hinge assembly 9 may pivot outwards a few inches thereby allowing a better fit to an extruding fiberglass or shower wall 51.

The shower caddy structure 15, the pivoting hinge assembly 9 and shower head support 35 are made from a durable plastic or a lightweight metal that either resists oxidation or is painted so as to resist oxidation. The gasket 25 is made from a durable rubber that has a high coefficient of friction so as to create friction between the gasket 25 and the water supply pipe 45.

It shall be noted that variations and alternatives of the present embodiment are readily apparent to those of ordinary skill in the art upon reading the present disclosure, and such variations and alternatives including equivalent structures and structural equivalents are incorporated in the invention unless otherwise expressly indicated in the claims.

With respect to the above description, it is to be realized that the optimum dimensional relationship for the various components of the invention 5, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 5.

The invention claimed is:

1. A shower caddy comprising:

(a) a shower caddy structure having a plurality of shelves and a pair of holes along top ends of said shower caddy structure, and wherein said holes are riveted to a pivoting hinge assembly;

(b) a gasket that contains a water supply pipe hole;

(c) a base that contains a set screw hole, and a water supply pipe hole;

(d) a shower head support;

wherein the shower head support contains a water supply pipe hole that corresponds with the water supply pipe hole of the gasket and the water supply pipe hole of the base;

wherein the base is sandwiched between the gasket and the shower head support;

wherein the shower head support contains a pair of screw holes;

wherein the screw holes of the shower head support correspond with holes of the pivoting hinge assembly;

wherein the shower caddy structure connects to the shower head support via the pivoting hinge assembly;

wherein the shower head support connects to the pivoting hinge assembly with a pair of screws;

wherein the pivoting hinge assembly enables movement of the shower caddy structure back and forth with regards to the shower head support to allow for a fitting against different wall extrusions.

2. The shower caddy of claim 1 wherein the shower caddy structure and shower head support are made from a durable plastic or a lightweight metal.

3. The shower caddy of claim 1 wherein the gasket is made of a durable rubber that has a high coefficient of friction.

* * * * *